US005099905A

United States Patent [19]

Rigter

[11] Patent Number: 5,099,905

[45] Date of Patent: Mar. 31, 1992

[54] SCREEN ASSEMBLIES

[76] Inventor: Stephen M. Rigter, 18 Riviera Rd., Miami, Gold Coast, Queensland 4213, Australia

[21] Appl. No.: 558,423

[22] Filed: Jul. 27, 1990

[30] Foreign Application Priority Data

Jul. 27, 1989 [AU] Australia ..... PJ5454

[51] Int. Cl.[5] ..... A47G 5/02

[52] U.S. Cl. ..... 160/273.1; 160/271; 160/275

[58] Field of Search ..... 1260/264, 271, 272, 1260/273.1, 290.1, 23.1, 266, 267.1, 275

[56] References Cited

U.S. PATENT DOCUMENTS

| | | | |
|---|---|---|---|
| 1,088,139 | 2/1914 | Fischer | 160/273.1 X |
| 1,143,863 | 6/1915 | Schenk | 160/271 |
| 1,184,305 | 5/1916 | Benko | 160/271 |
| 1,241,425 | 9/1917 | Nelson | 160/264 |
| 1,317,579 | 9/1919 | Johnson | 160/264 |
| 1,583,133 | 5/1926 | Fierman | 160/264 |
| 1,683,844 | 9/1928 | Nevess | 160/275 |
| 1,736,432 | 11/1929 | Dixson | 160/272 |
| 1,833,140 | 11/1931 | Traut | 160/264 |
| 1,885,756 | 11/1932 | Norquist et al. | 160/271 |
| 3,149,665 | 9/1964 | Handford | 160/272 |
| 4,825,921 | 5/1989 | Rigter | 160/271 X |
| 9,724,222 | 10/1910 | Whitmore | 160/264 |

*Primary Examiner*—Carl D. Friedman
*Assistant Examiner*—Korie H. Chan
*Attorney, Agent, or Firm*—Hoffman, Wasson & Gitler

[57] ABSTRACT

A screen assembly comprising a roll carrying screening material such as flyscreen material, a pair of guides at opposite sides of said roll and receiving opposite edges of said material and a strengthening element fixed for movement with the screen material and extending parallel to the roll, the strengthening element being formed of thin resilient non-extensible material. The element has an arcuate cross section to enable it to be rolled up onto the roll and apertures or slots at either end for engagement over guide tracks in the opposite guides.

20 Claims, 5 Drawing Sheets

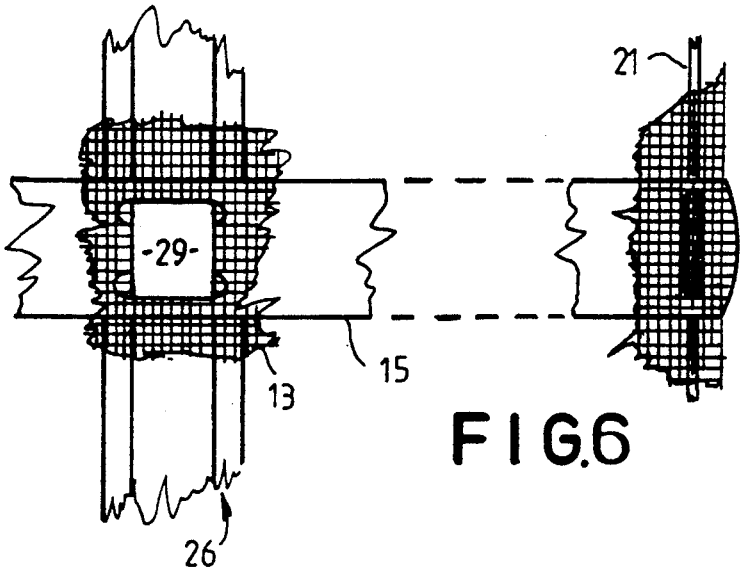
FIG.6
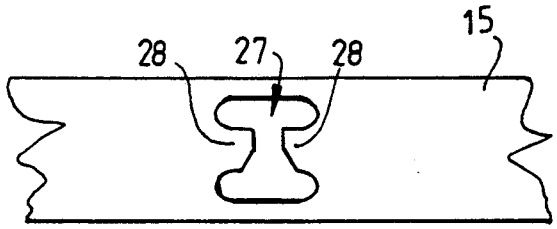
FIG.7
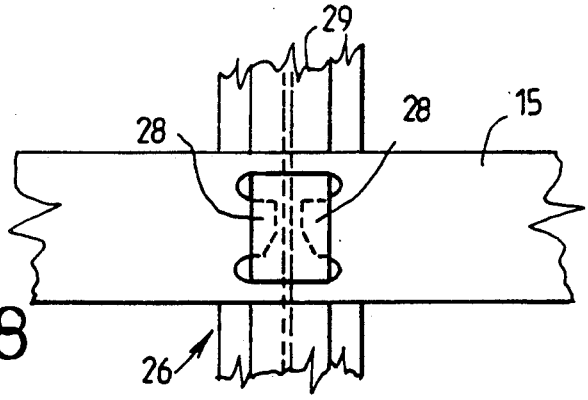
FIG.8
FIG.9
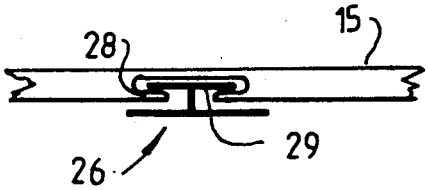

SCREEN ASSEMBLIES

FIELD OF THE INVENTION

This invention relates to improvements to screen assemblies for use for example as blinds, or for fly screens for windows or doors.

DESCRIPTION OF THE RELATED ART

Screens such as insect screens of a variety of different types are known. Such screens have various characteristics or features depending upon whether they are intended for use in doorways or with windows. When used with windows a variety of distinct types have been developed for sliding, double hung, casement, hopper or other window constructions. Similarly screens are constructed in different ways for sliding and swinging doors.

There has always been a tendency for land prices to be at a premium for sites having an aesthetic outlook or view. Screen constructions to data have been such that they permanently obstruct a considerable area of a window or door and thus detract from or diminish the quality of the view through the window or door. Even with sliding windows or doors, the screen, whilst it may be mounted for sliding movement relative to the window or door, nevertheless obstructs the view through either the door or window or adjacent glass panel.

Some windows, because of their construction require winders to enable the opening or closing of the window if the window is fitted with a screen. This is the case with hopper windows. This adds to the cost of screening a window against insects. One attempt at solving this problem has been to form a movable panel in the screen which may be opened to provide for access to the window to facilitate opening thereof. This panel is then closed once the window is opened. Such screens are a nuisance in their operation and still do not solve the problem of obstructing vision through the window.

It has previously been proposed to have screens which may be withdrawn from a roll and extended across a window when required and which may be withdrawn into the roll when screening of the window was no longer required. Such arrangements enabled unimpeded view through the window to be obtained. Such screens had opposed guide tracks in which rollers or frictional guide members were held captive. Such rollers or members were bulky and because of this did not form a neat compact shaped roll within a take-up housing for the roll.

In my U.S. Pat. No. 4,825,921, I describe a screen assembly which employs stiffening elements which are secured to the screen material along opposite edges thereof and received in guides. Further intermediate stiffening elements are located between the side stiffening elements. This assembly suffers some disadvantages as when the screen is wound up onto the roll, the elements are wound about themselves thereby greatly increasing the diameter of the roll necessitating a large roller housing.

A further screen assembly employing a stiffening element is disclosed in U.S. Pat. No. 4,707,018 where the screen material is wound on one roll and the stiffening element wound on a further separate roll. This arrangement again greatly increases the size of the housing need to contain the rolls and furthermore, the opposite side edges of the screen in this arrangement are not constrained against movement so that its application is not suited to use with windows and doors.

SUMMARY OF THE INVENTION

It is an object of the invention to provide an improved screen assembly for use as blinds, or for fly screens for windows or doors which at least minimises some of the disadvantages above.

According to one aspect of the invention there is, provided a screen assembly comprising of a web or sheet of screen material, a take-up roll onto, and from which, the material may be retracted or withdrawn, at least one strengthening and supporting element formed of a relatively thin resilient, substantially non-extensible material, the or each said element having an arcuate transverse cross-section and being secured to or formed with said material and extending substantially parallel to said roll, and a pair of spaced apart guides on opposite sides of said take-up roll and receiving opposite edges of said material and opposite ends of the or each said element, each said guide including a longitudinally extending guide track, and wherein the opposite ends of the or each said element are provided with apertures whereby the or each said element may engage said guide tracks.

The web or sheet may comprise of woven or non-woven material. For example, the web or sheet may be a sheet made from fabric, metallic or non-metallic material. Where the web or sheet is solely intended to inhibit the passage of insects a foraminous material either of plastics or metal may be used. Where the web or sheet is not solely intended to inhibit the passage of insects but also serves as a blind to screen off a portion of a window or door so that the view through that portion is impeded, a sheet of fabric or sheet of metallic or non-metallic material may be used. The take up roll may be oriented horizontally or vertically and the sheet has two opposed edges which, when the take-up roll is vertically oriented extend horizontally in use when the sheet is withdrawn from the roll.

The strengthening and supporting elements have a curved, transverse cross section so that the elements have one surface which is concave in shape and their opposite surface convex. The element may be readily rolled up in the direction of the concave surface, which is of similar shape to portion of the take-up roll. Because of the transverse contour of the element, the element assumes a substantially straight configuration and if it is bent in any direction it returns to the substantially straight configuration when released or unrestrained.

Suitably the guides are provided with a brush-like seal which engages with the adjacent side edge of the screen to urge same against an inside face within the guide. The elements are preferably made from metal and spring steel has been found particularly suitable although the elements may be made from other metallic materials or plastics. In one embodiment, the elements are of minimal thickness, of a width of approximately 2.5 cm and of a length commensurate with the width of the web or sheet.

In use the blind or screen is guided by the opposite guides during it's movement into and out of the take-up roll and preferably the guides which are substantially parallel to each other are secured adjacent a window or door opening. The guides suitably include two opposed arms defining an opening into which the web or sheet and the ends of the strengthening elements extend. Suitably one of the terms is longer than the other arm and the short arm may be fixed adjacent to the window or door opening or other supporting member. Suitably projecting from the short arm in one form are a pair of spaced flanges, one such flange defining the track over which the apertures or slots in the elements locate and the pair of flanges define therebetween a channel for receiving the brush-like seal.

In a further form, the guide is in two parts comprising a first member having a first flange arm for defining the guide track and a second member forming a cover releasably engageable with the first member and defining the other arm.

The elements may be formed separate from the web or sheet and secured or attached thereto such as by welding or adhesives. Alternatively, they may be formed integrally with the web or fabric, parallel to the take-up roll.

In a further aspect of the invention, the elements may be intermediately supported by means of a track extending substantially parallel to the opposite side guides. For this purpose, the elements may be provided with an aperture suitably of an "I" configuration so as to define a pair of fingers which may be engaged with the intermediate track. The latter is suitably provided with opposite guiding flanges behind which the fingers may locate so as to captured by the track for sliding movement therealong. This arrangement permits extended widths of screen to be accommodated. Alternatively, the intermediate track may include a single guide flange and the aperture in the element defines a single finger for location beneath the guide flange.

The take-up roll may include a housing with an access opening through which the web or sheet may extend. The housing may be substantially cylindrical or alternatively of square or rectangular section. The take-up roll may include a spindle or shaft around which the web or sheet may be wound. It is preferable that the spindle be biased suitably by a spring to tend to retract draw the web or sheet onto the spindle.

In one of the aspects of the invention where a screen is provided with a plurality of stiffening and supporting elements, the elements are arranged such that the concave faces all are directed to one side of the web or sheet so that they may be rolled up neatly onto the take-up roll.

Suitably said material is secured at one end to said roll and provided at its opposite end with a draw frame assembly, said draw frame assembly being received at either end in said guides and being adapted to be raised or lowered to permit said material to be retracted or withdrawn from said roll.

Preferably also catch means are provided at the ends of said guides opposite said roll, said draw frame assembly being adapted to be engaged with said catch means to maintain said screen material in a said withdrawn attitude. The draw frame assembly suitably includes at each end latch means adapted for engagement with said catch means, and said catch means includes a recess, said latch means being movable into said recess to maintain said screen material in a withdrawn attitude.

Suitably said latch means includes a latching finger and said recess is inclined inwardly of said screen material and includes a stop, said latching finger moving into said recess and behind said stop when said draw frame assembly is pivoted inwardly.

BRIEF DESCRIPTION OF THE DRAWINGS

In order that the invention may be more readily understood and put into practical effect, reference will now be made to the accompanying drawings which illustrate a preferred embodiment of the invention and wherein:

FIG. 6 is a part elevational view of an alternative embodiment of the invention incorporating a central supporting element;

FIG. 7 illustrates the preferred aperture in the stiffening element for engagement with the central supporting element;

FIGS. 8 and 9 illustrate in elevational and plan view the manner of engagement between the central supporting element and stiffening element;

DETAILED DESCRIPTION OF THE INVENTION

Figure 1:
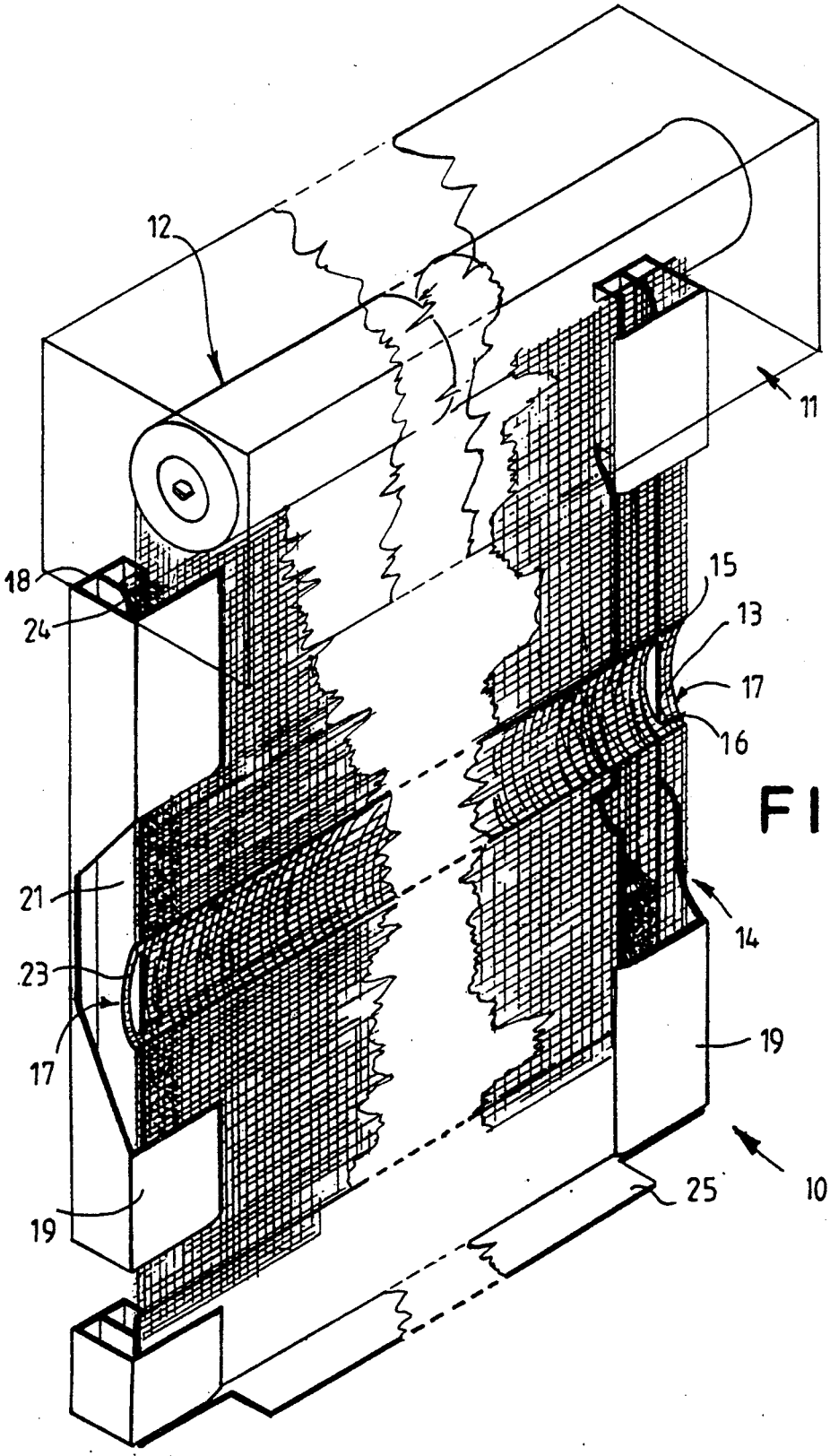
FIG. 1 is a diagrammatic perspective view of a screen assembly according to the invention.

Referring to the drawings and firstly to FIG. 1, there is illustrated a screen assembly 10 according to the present invention comprising a roller housing 11 which supports rotatably therein a take-up roller 12, and a screen material 13 which in this embodiment is formed of foraminous material and is secured at one end to the roller 12 so that it may be rolled up thereon or unrolled therefrom. Preferably biasing means in the form of a spring are associated with the roller 12 to apply a force thereto tending to cause the screen material to wind up onto the roller 12.

Extending away from the roller housing 11 and on opposite sides thereof are a pair of opposite guides 14 which are arranged to received opposite edges of the screen material 13. The guides 14 also receive opposite ends of a strengthening and supporting element 15 which is secured to the screen material 13 by adhesives or in any other suitable manner and which extends substantially parallel to the take-up roller 12. The element 15 is formed of a thin resilient non extensible material such as spring steel and being most preferably formed with an arcuate cross section provides a stiffening to the screen material in three mutually perpendicular directions. The elements 15 have a concave face 16 and an opposite convex face 17 and as shown in FIG. 1, the concavity of the element 15 is directed to the side of the screen material 13 upon which the roller 12 is located. This then facilitates roll up of the screen material 13 and associated element 15 onto the roller 12 as the concavity in the element 15 corresponds with the curved surface of the roller 12.

Figure 2:
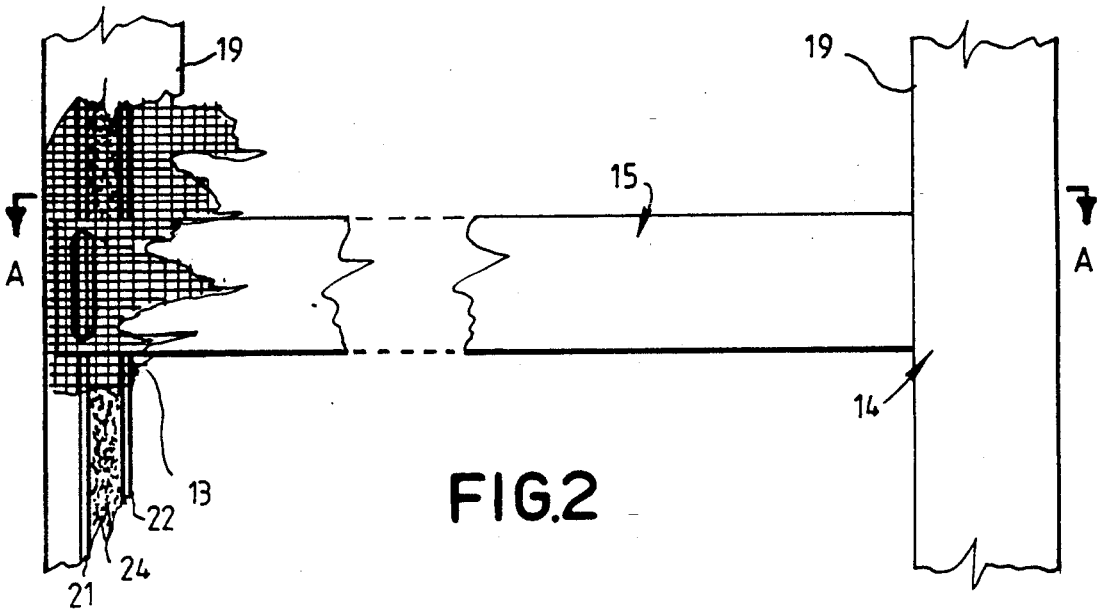
FIG. 2 is an part fragmentary elevational view showing portion of the screen assembly and associated supporting elements.
Figure 3:
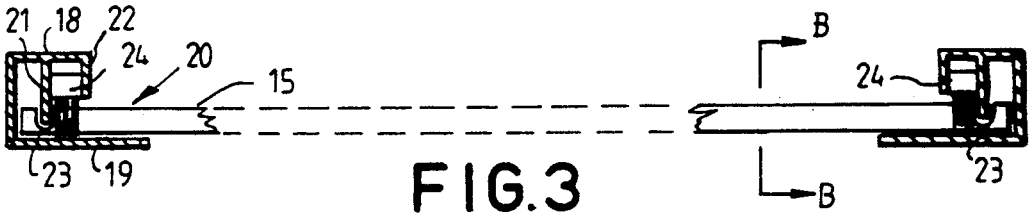
FIG. 3 is a sectional view along line A—A of FIG. 2.
Figure 4:
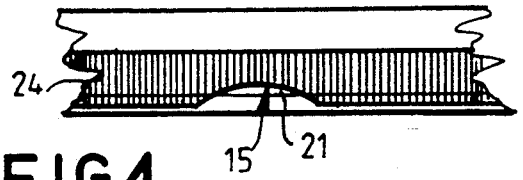
FIG. 4 is a sectional view along line B—B of FIG. 3.

As shown more clearly in FIGS. 2 to 4, the guides 14 are provided with a pair of spaced apart parallel arms 18 and 19 defining therebetween an opening 20 for receipt of the edges of the screen material 13 and ends of the element 15. One of the arms 18 is smaller than the other arm 19 and is provided with a pair of spaced apart parallel flanges 21 and 22 which are directed towards the other arm 19 but terminate short thereof. The inner flange 21 defines a track which is adapted to be engaged by an end of the element 15 and for this purpose the opposite ends of the element 15 are provided with slots or apertures 23 which extend transverse to the longitudinal direction of the element 15. Because the elements are of arcuate cross section, the slots or apertures 23 are of three dimensional form and engage over the flange 21 in the manner shown so as to be captive in the guides 14 between the flange 21 and rear face of the arm 19.

Disposed in the channel defined between the respective flanges 21 and 22 is a brush-like seal 24 of the type commonly used in sliding windows and doors as wind and weather seals. The seal 24 engages with the screen material 13 and the element 15 in the manner shown in FIGS. 3 and 4 so as to urge the material 13 and element 15 against the rear face of the arm 19 so as to seal the screen but at the same time permit relatively free movement of the element 15 along the flange 21.

It will be apparent that when the screen assembly 10 is closed, a force applied against the screen material 13 will be strongly resisted by the element 15 which through its engagement with the flanges 21 in the manner described above will prevent detachment of the screen material 13 from the guides 14.

The screen assembly 10 as shown in FIG. 1 also includes a frame member 25 which is secured to the free end of the screen material 13 to serve as a gripping handle to permit the screen assembly 10 to be open and closed by hand. The frame member 25 suitably is of T- or L- shape in cross section and the ends thereof extend into the guides 14 so as to be slidable therealong.

Figure 5:
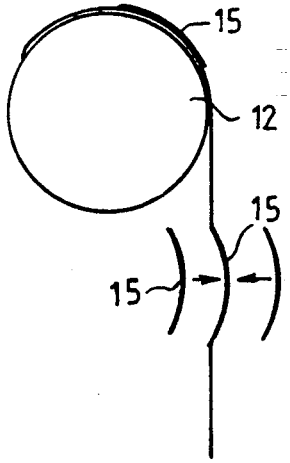
FIG. 5 illustrates the manner in which the screen rolls up onto the supporting roller.

FIG. 5 illustrates in sectional view the manner in which the screen material 13 is rolled up onto the roller 12 where a plurality of supporting elements 15 are provided. It will be apparent that the concavity of the elements substantially matches the curvature of the roller 12 so as to ensure neat fitting of the screen material 13 and elements 15 about the roller 12.

Referring now to FIGS. 6 to 9, there is illustrated a further preferred form of the invention which incorporates a central supporting member 26 which extends parallel to the guides 14 and which is arranged intermediately therebetween and supported in a fixed attitude between the housing 11 and say a window sill to which the screen assembly is to be applied. So as to engage with the central supporting member 26, the element 15 is provided with a cut-out portion 27 which is suitably of I-profiled form so as to define a pair of opposite inwardly directed fingers 28. The central supporting member 26 in this embodiment is of generally I-sectioned form or double channel form so as to define an outer flange 29 behind which the respective fingers 28 can locate in the manner shown in FIGS. 8 and 9. In an alternative arrangement, the central supporting member 26 may be of single channel sectioned form with one of the channel flanges engaging in an aperture similar to that shown at 27 but requiring only one projecting finger 28 to engage under the channel flange.

It will be apparent in this embodiment that as the screen assembly is rolled up or unrolled, the supporting element 15 will be guided in a sliding manner along the central supporting member 26 and at the same time this engagement will support the screen material at intermediate positions between the guides 14. Preferably at the upper end of the screen assembly, the central supporting member 26 is provided with a lead in portion so that the fingers 28 will locate behind the flange 29 as the element 15 is unrolled from the roller 12.

If desired, the screen assembly may be mounted with the housing 11 concealed within the framework or wall of a building to provide a screen adjacent a window, door or other desired location. Alternatively, the screen assembly may be fitted to existing framework surrounding a window door or other opening.

Figure 10:
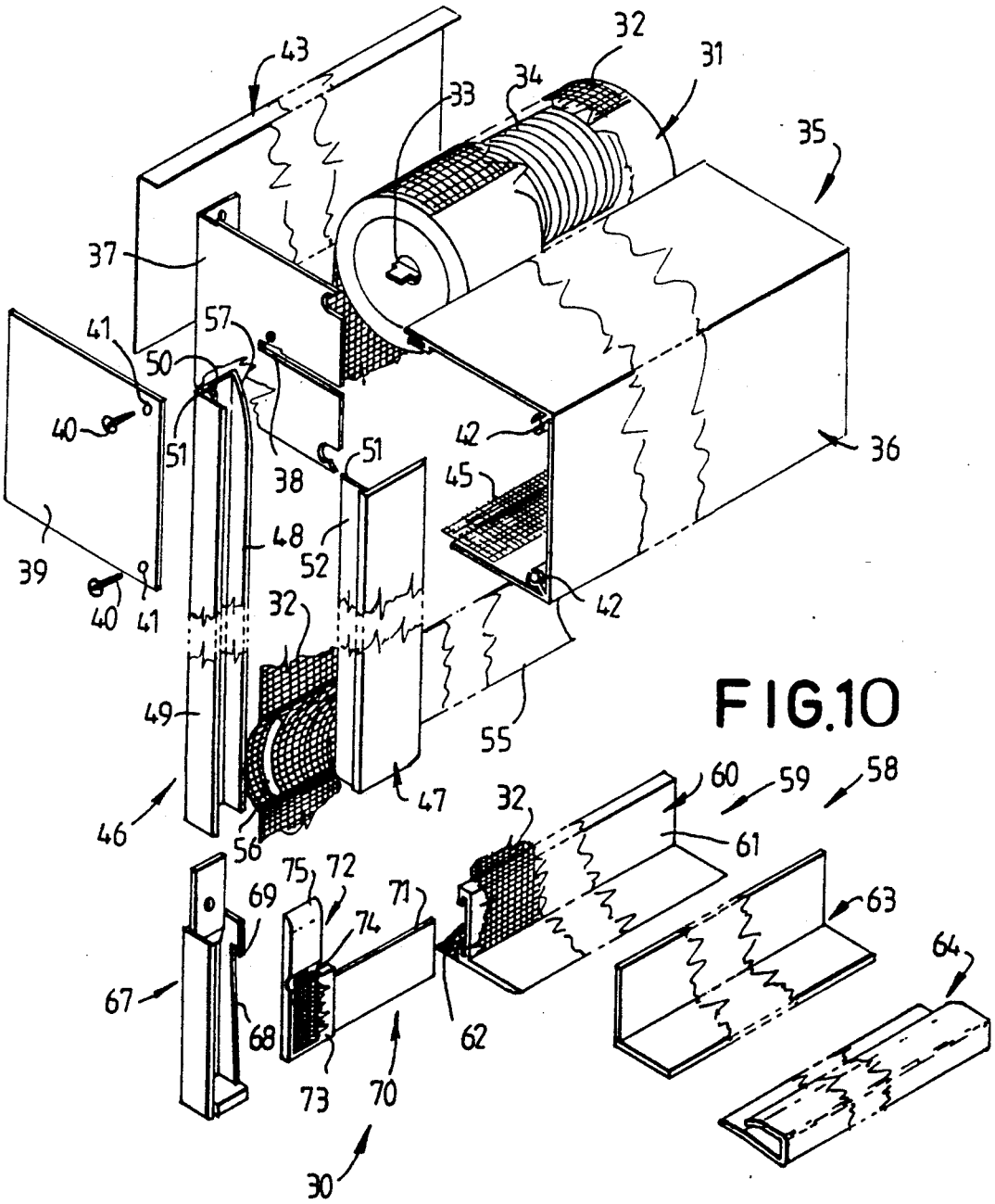
FIG. 10 is an exploded view of a further form of screen assembly according to the present invention.

Referring now to FIG. 10 there in illustrated the exploded view, a further form of screen assembly 30 according to the present invention which has the same principles of operation as the screen assembly described above. This assembly 30 includes a roller 31 for supporting screening material 32 such as fly screen material, the roller 31 being of the same form as employed in spring loaded roller blinds and including a support axle 33 which extends outwardly of the roller 31 at each end and an internal spring 34 which opposes rotation of the roller 31 in one direction. The roller 31 is adapted to be supported within a housing assembly 35 comprising a main U-shaped housing 36 having a pair of removable end plates 37 which are slotted at 38 to receive and support the axle 33 of the roller 31 against rotation in conventional fashion. End cover plates 39 are provided to be located over the plates 37 and close off the opposite ends of the housing 36 by means of screw fasteners 40 passed through apertures 41 in the plates 37 and into integrally formed screw receiving extrusions 42 in the housing 36. A rear cover 43 may also be provided for engagement with the housing 36 so as to substantially enclose the rear of the housing 36. The lower wall 44 of the housing 36 may be provided with a strip of material 45 which preferably comprises screen material and which is adapted to engage the screen material 32 so as to prevent insects coming into the building around the roll 31 and through the housing 35. The strip 45 is arranged to contact the screen material 32 only when the screen is fully rolled out with the screen material 32 in this position being on its smallest diameter about the roil 31.

Figure 11:
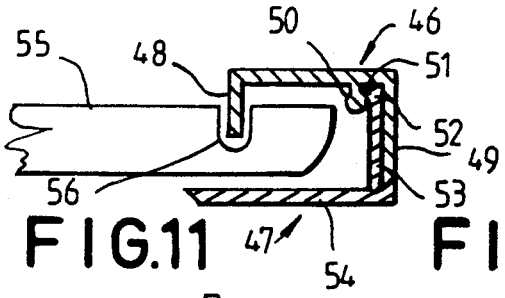
FIG. 11 is a sectional view illustrating the engagement of the screen supporting element with the guides.

Fixed to the plates 37 or formed integrally therewith are respective elongated guide members 46 which are adapted to be secured to the sides (or top and bottom) of a window or door opening and a cover 47 is adapted to be releasably engaged with the guide member 46 in the manner shown in FIG. 11. For this purpose the guide member 46 is of channel shaped form with one of the legs 48 defining a guide track and the other leg 49 defining with an elongated headed member 50, a recess 51 for receiving an enlargement 52 on the end of a rib 53 attached to the front flange 54 of the cover 47. This arrangement permits the cover 47 to be releasably clipped into engagement with the guide 46 in the manner shown in FIG. 11.

One or more strengthening and stiffening elements 55 of arcuate cross-section and of the same form as described previously are secured to the screening material 32 to extend parallel to the roll 31. Preferably the elements 45 are secured to the screening material 32 by melt gluing. As previously, the elements 45 are provided with elongated slots 56 adjacent their opposite ends which extend transversely to the longitudinal direction of the elements 55. The opposite ends of the elements 55 are adapted to be received in the guides 46 so that the slots 56 locate over the tracks 48 to be held captive by the cover 47 as shown in FIG. 11.

The elements 55 preferably have substantially the same or similar radius as the roll 31 so that they closely conform to the surface thereof or previously rolled on material 32 when the material 32 is wound onto the roll 31.

The upper end of the track 48 is preferably tapered at 57 so as to facilitate movement of the elements 55 into engagement with the track 48 or disengagement therefrom.

Figure 12:
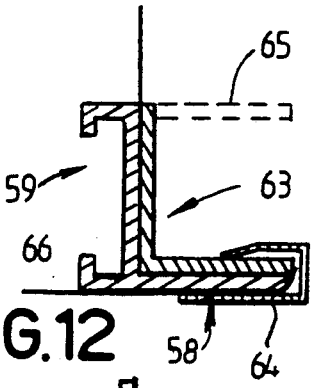
FIG. 12 is a sectional view illustrating the draw bar arrangement at the lower end of the screen.

The free end of the material 32 is preferably secured to a main draw bar or frame assembly 58, comprising a generally L-shaped main draw bar 59 which includes an upstanding flange 60 defining on one face 61 a surface to which the material 32 may be adhered and on its opposite face a longitudinally extending channel-shaped groove 62. An angle sectioned stiffening member 63 is adapted to mate neatly with the draw bar 59 in the manner shown in FIG. 12 and is held in engagement therewith by means of a channel shaped joiner 64 which is formed of a resilient material, such as plastics and which is arranged to clamp adjacent flanges of the draw bar 59 and stiffener 63 together. If desired the stiffener 63 may include a top flange 65 shown in dotted outline in FIG. 12 to define a handle for facilitating the raising or lowering of the screen assembly. A sealing strip of material 66 is either adhered to the draw bar 59 or sandwiched between the draw bar 59 and joiner 64 so as to ensure sealing against the opening adjacent the draw bar.

The lower end of each guide 46 is provided with a catch 67 which is of generally channel shaped form but which includes on one side an inwardly angled slot 68 terminating and curving into in a return flange or stop 69. A latching member 70 is provided at each end of the draw bar 59 and includes a tongue 71 which is adapted to be slidably engaged in the channel 62 and a latch part 72 which is arranged to be located in the angled slot 68 and beneath the return flange 69 in the manner (see FIG. 13).

When the tongue 71 is located in the channel 62 the front face 73 of the latch part 72 is disposed in substantially the same plane as the face 61 of the draw-bar 59 and the screen material 32 also is adhered to the face 73 as shown. A groove 74 prevent adhesive moving past the face 73 to the upper end of the latch part 72 so that the screen material 32 is only secured to the face 73 thereby leaving the upper portion 75 of the latch part 72 free.

In use and when the screen is required to be moved to a closed position, downward pressure is applied to the outwardly extending flanges of the draw-bar assembly 58 so as to overcome the spring force applied by the spring 34 causing the material to be unwound from the roll. The stiffening elements 55 are guided into the guides 46 so that the apertures 56 locate over the track 48 to be guided therealong and be held captive thereby. The downward force on the outer flanges of the draw bar assembly 58 tend to cause twisting of the draw bar assembly 58, however, this twisting action is opposed by the latching member 70 as the latching portion 75 will be urged towards the rear of the flange 54 of the cover member 47.

Figure 13:
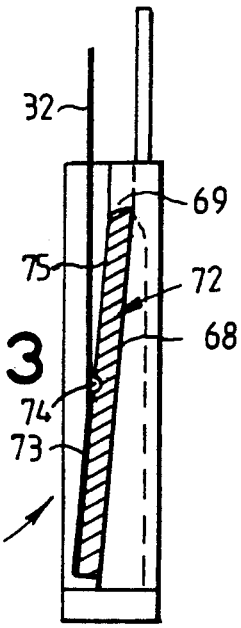
FIGS. 13 and 14 illustrate the preferred catch for maintaining the screen in a closed attitude in an engaged and disengaged position.
Figure 14:
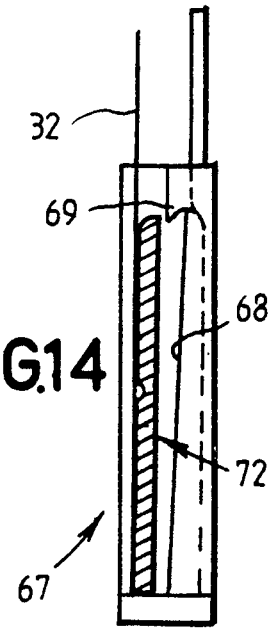

When the screen material 32 is lowered to its lowermost position, the draw bar assembly 58 may be pivoted slightly inwardly to move the latch part 72 into the slot 68 to be retained by the return flange 69, the spring loading of the roller maintaining an upwards bias on the screen material 32 and the latch portion 75 engaged with the flange 69 (see FIG. 13). When it is desired to release the lower end of the screen to enable it to be raised, downward pressure is applied to the outwardly projecting flanges of the draw bar assembly 58, thereby causing the latch part 72 to pivot or twist outwardly beyond the return flange 69 being assisted by the curved nature of the flange 69 as shown in FIG. 14, thus releasing the material 32.

The screen assemblies as described above may be fitted to sliding glass windows so as to close and open as the window is opened or closed. For this purpose an angle or other section is attached to the sliding sash at the opening side and coupled to the draw bar assembly 58 of the screen assembly. Thus as the window is opened the screen is drawn over the opening with it and similarly when the window is closed the screen will be retracted.

Figure 15:
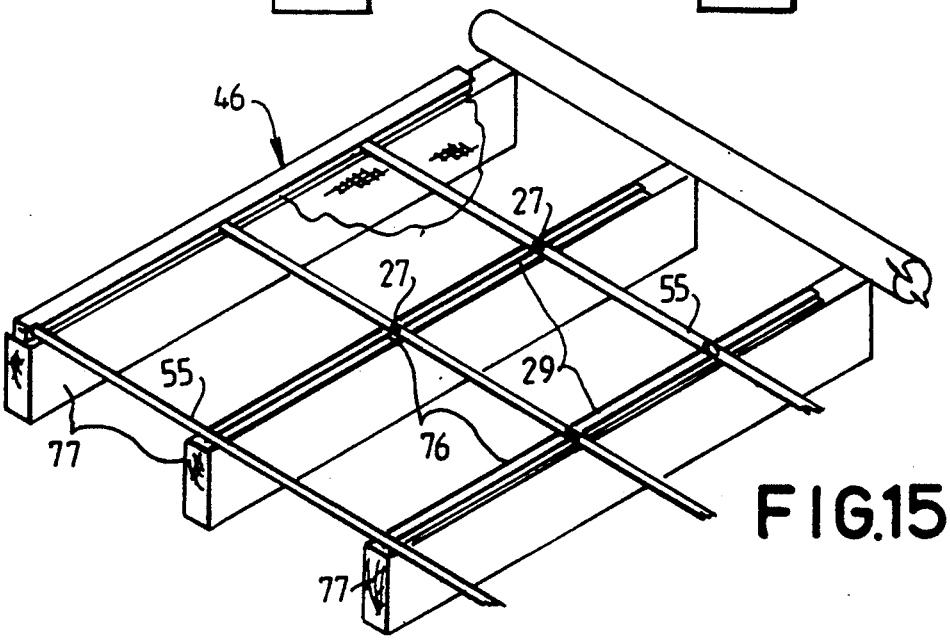
FIG. 15 is a part perspective view showing the application of the invention to pergolas or other large areas to be screened.

Referring now to FIG. 15 there is illustrated an arrangement wherein the screen material is supported at a number of spaced locations, in this case by means of a series of intermediate tracks 76 parallel to the guides 46, the tracks 76 being supported on intermediate bearers or joists 77. The respective stiffening elements 55 are engaged with the intermediate tracks 76 with the apertures 27 in the elements 55 receiving the flanges 29 of the tracks 76 in a similar manner to that shown in FIGS. 7 to 9. This arrangement may be used for pergolas, multiple windows or screened enclosures.

The arrangements described above are suited particularly to usage as flyscreens in which case the material 13 comprises a foraminous material however the screen assembly may be equally applied to usage with other materials such as a vinyl or imperforate plastics material for forming a blind or partition.

The screen assembly of the invention may be oriented with the roll either horizontally say at the head of a window or alternatively vertically at one side of an opening. The screen assembly of the invention may also be employed as a cover for a pergola in which case the roller may be oriented horizontally on top of or on the underside of the pergola framework. Where used in the latter application, the strengthening and supporting elements may be substantially increased in width so as to provide the desired support to the screening material. Alternatively, additional concave supporting elements may attached for example by adhesives to either or both sides of the elements 15 (or 55) as shown in FIG. 5 to provide additional stiffening and support to the screen material.

Whilst it is most preferably to employ strengthening and supporting elements of concave or arcuate cross section, substantially flat elements may be employed in which case they are provided with configurations at each end to engage with the track flange 23 (or 21). Such configurations may comprise raised dimples formed in the ends of the element or any other arrangement which will ensure that the element can be engaged in a non detachable manner at each end of the flange 23.

Where very large areas are to be screened and the screening material is not made large enough, the material may be joined at the concave supporting elements.

All such variations and modifications to the invention as would be apparent to persons skilled in the art are deemed to fall within the broad scope and ambit of the invention as defined in the appended claims.

I claim:

1. A screen assembly comprising a web or sheet of screen material, a take-up roll onto, and from which, said screen material may be retracted or withdrawn, at least one elongated strengthening and supporting element formed of a relatively thin resilient, substantially non-extensible material, said supporting element having an arcuate transverse cross-section and being secured to or integral with said screen material and extending substantially parallel to said taken-up roll, and a pair of spaced apart substantially parallel elongated guides, said elongated guides being adapted to receive opposite edges of said screen material and opposite ends of said supporting element, each of said elongated guides including a longitudinally extending guide member, wherein the opposite ends of said supporting element are provided with apertures extending transversely of said supporting element, whereby when said screen material and said supporting element are withdrawn from said take-up roll, said apertures at said opposite ends of said supporting element locate over and engage said guide members of the respective spaced apart guides so that said supporting element is guided along said elongated guides and restrained against movement in a direction parallel to its length.

2. A screen assembly according to claim 1, wherein each of said elongated guides includes means for preventing detachment of said supporting element from said guide member in a direction normal to the plane of said screen material when said screen material is withdrawn from said take-up roll.

3. A screen assembly according to claim 2, wherein said means for preventing detachment of said supporting element includes cover means spaced from each guide member and defining therewith a longitudinal slot for receipt of one of said opposite edges of said screen material and one of said opposite ends of said supporting element.

4. A screen assembly according to claim 3, wherein said cover means comprises flange means extending substantially normal to said guide member and disposed substantially parallel to the plane of said screen material when said screen material is withdrawn from said take-up roll.

5. A screen assembly according to claim 1, wherein each guide member includes a base flange lying in a plane parallel to the plane of said screen material when withdrawn from said roll and wherein said guide member includes a flange extending normal to said base flange.

6. A screen assembly according to claim 1, wherein said elongated guides include elongated seal means adapted to engage said screen material.

7. A screen assembly according to claim 1, wherein said screen material is secured at tone end to said take-up roll and provided at its opposite end with an elongated draw frame assembly, said draw frame assembly having ends being received in said elongated guides and being adapted to be raised or lowered to permit said screen material to be retracted or withdrawn from said take-up roll.

8. A screen assembly according to claim 7 and including catch means at the ends of said elongated guides opposite said take-up roll, said draw frame assembly being adapted to be engaged with said catch means to maintain said screen material in a said withdrawn attitude.

9. A screen assembly according to claim 8, wherein said draw frame assembly includes at each of said ends latch means adapted for engagement with said catch means, said catch means including a recess and said latch means being movable into said recess to maintain said screen material in a withdrawn attitude.

10. A screen assembly according to claim 9, wherein each said latch means includes a latching member and wherein each said recess is slanted away from the plane of said screen material when said screen material is withdrawn from said take-up roll, said recess including a stop and said latching member moving into said recess and behind said stop when said draw frame assembly is pivoted about an axis extending longitudinally of its length in one direction and moving out of said recess and free of said stop when pivoted about said axis in the opposite direction.

11. A screen assembly according to claim 1 and including biasing means associated with said take-up roll and adapted to urge said take-up roll in a direction tending to retract said screen material.

12. A screen assembly according to claim 1 and including an intermediate guide member disposed between said elongated guides and extending substantially parallel thereto, and wherein said supporting element includes an aperture intermediate its ends, said aperture being adapted to locate over said intermediate guide member so that said element is guided therealong upon retraction and withdrawal of said screen material.

13. A screen assembly according to claim 12, wherein said supporting element includes a longitudinally extending tongue arranged centrally of said supporting element, and extending into said aperture and wherein said intermediate guide member includes a longitudinally extending flange beneath which said tongue locates.

14. A screen assembly according to claim 1, wherein said screen material comprises a foraminous material.

15. A screen assembly comprising a web or sheet of screen material, a take-up roll onto and from which the screen material may be retracted or withdrawn, biasing means for urging said take-up roll in a direction tending to retract said screen material, a pair of spaced apart guides on opposite sides of said take-up roll and receiving opposite edges of said screen material, said screen material being secured at one end to said take-up roll and at its opposite end to an elongated draw frame assembly said draw frame assembly projecting at its opposite ends into said guides and catch means for maintaining said screen material in a withdrawn attitude, said catch means including a recess at the end of each said guide opposite said take-up roll, each recess extending longitudinally of said guides and being slanted away from the plane of said screen material when said screen material is withdrawn from said take-up roll and defining at one end a latch stop, and said draw frame assembly including latching members at the opposite ends of said draw frame assembly, each said latching member being movable into said recess and behind said stop upon pivotal movement of said draw frame assembly about an axis extending longitudinally of its length in one direction so as to maintain said screen material in a withdrawn attitude, said draw frame assembly being pivotally movable in the opposite direction about said axis so as to move said latching member out of said recess and away from said stop so as to permit said screen material to be moved to a retracted attitude, said screen material includes at least one strengthening and supporting element formed of a relatively thin, resilient substantially non-extensible material, said supporting element extending substantially parallel to said take-up roll has opposite ends being received by said opposite guides, said supporting element has an arcuate transverse cross-section and is provided at each of said opposite ends with respective apertures adapted for location over and engagement with longitudinally extending guide members in said opposite guides.

16. A screen assembly according to claim 15, wherein each guide member includes a base flange disposed in a plane parallel to the plane of said screen material and wherein said guide member includes a guide flange extending normal to said base flange.

17. A screen assembly according to claim 16, wherein said guide member includes a cover flange parallel to said base flange and spaced from said guide flange to define a slot therewith for receipt of an edge of said screen material and an end of said supporting element.

18. A screen assembly according to claim 15, wherein said draw bar assembly is of L-shaped transverse cross-section including a first flange coplanar with the plane of said screen material and to which said screen material is secured, and a second flange at right angles to said first flange.

19. A screen assembly comprising of a web or sheet of screen material, a take-up roll onto, and from which, the screen material may be retracted or withdrawn, at least one strengthening and supporting element formed of a relatively thin resilient, substantially non-extensible material, each supporting element having an arcuate transverse cross-section and being secured to or formed with said screen material and extending substantially parallel to said take-up roll, a pair of spaced apart opposite guides for receiving opposite edges of said screen material and opposite ends of said supporting element, an intermediate guide member extending substantially parallel to said guides, and said supporting element having an aperture intermediate said ends of said supporting element for location over and engagement with said intermediate guide member, whereby said supporting element is guided therealong upon withdrawal and retraction of said screen material and restrained against movement in a direction parallel to its length.

20. A screen assembly according to claim 16, wherein said supporting element includes a longitudinally extending tongue arranged centrally of said supporting element and extending into said aperture, and wherein said intermediate guide member includes a flange disposed in a plane parallel to the plane of said screen material when withdrawn from said roll, said tongue being adapted for location beneath said flange.

* * * * *